US011534932B2

(12) United States Patent
Johnson

(10) Patent No.: US 11,534,932 B2
(45) Date of Patent: Dec. 27, 2022

(54) FLIP-COMB MECHANISM FOR HAIR CLIPPER

(71) Applicant: WAHL CLIPPER CORPORATION, Sterling, IL (US)

(72) Inventor: Bruce V. Johnson, Sterling, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 89 days.

(21) Appl. No.: 17/018,585

(22) Filed: Sep. 11, 2020

(65) Prior Publication Data

US 2021/0086377 A1 Mar. 25, 2021

Related U.S. Application Data

(60) Provisional application No. 62/902,809, filed on Sep. 19, 2019, provisional application No. 62/902,840, filed on Sep. 19, 2019, provisional application No. 62/902,846, filed on Sep. 19, 2019.

(51) Int. Cl.
*B26B 19/38* (2006.01)
*B26B 19/20* (2006.01)

(52) U.S. Cl.
CPC ..... *B26B 19/386* (2013.01); *B26B 19/20* (2013.01); *B26B 19/3813* (2013.01)

(58) Field of Classification Search
CPC ... B26B 19/386; B26B 19/3813; B26B 19/20; B26B 19/38
USPC ..... 30/201
See application file for complete search history.

(56) References Cited

U.S. PATENT DOCUMENTS 2,317,928 A * 4/1943 Martell ..... B26B 19/20 30/200
2,381,046 A 8/1945 Giorgi
2,617,188 A * 11/1952 Giorgi ..... B26B 19/20 30/201
2,624,113 A * 1/1953 Giorgi ..... B26B 19/20 30/201
2,722,741 A * 11/1955 McAuliffe ..... B26B 19/20 30/201
2,974,412 A * 3/1961 Clark ..... B26B 19/20 30/201
3,060,573 A * 10/1962 Clark ..... B26B 19/20 30/201

(Continued)

OTHER PUBLICATIONS

International Search Report and Written Opinion received for PCT/US2020/050813 dated Dec. 8, 2020.

*Primary Examiner* — Nhat Chieu Q Do
(74) *Attorney, Agent, or Firm* — Greer, Burns & Crain, Ltd

(57) ABSTRACT

A flip comb mechanism is provided for a hair clipper having a bladeset including a moving blade reciprocating relative to a stationary blade, the flip comb mechanism includes an attachment comb having at least one comb tooth and a comb base. The flip comb mechanism also includes a mount with a hinged bracket, having a first portion which is attached to the stationary blade, and a second portion which is attached to the comb base, the hinged bracket is configured to pivot the attachment comb between an operational position located against to the stationary blade, and an open position where the attachment comb is rotated away from the stationary blade to clear collected cut hair between the attachment comb and the stationary blade, wherein a hinge of the hinged bracket is proximate the comb base.

9 Claims, 11 Drawing Sheets

(56) References Cited

U.S. PATENT DOCUMENTS

| | | | | |
|---|---|---|---|---|
| 3,939,850 | A | 2/1976 | Wahl | |
| 4,622,745 | A | 11/1986 | Wahl | |
| 5,787,587 | A | 8/1998 | Wahl et al. | |
| 5,933,964 | A | 8/1999 | Altamore | |
| 5,937,526 | A | 8/1999 | Wahl et al. | |
| 6,604,287 | B2 | 8/2003 | Melton et al. | |
| 9,545,729 | B2 | 1/2017 | Buck, Jr. et al. | |
| 10,016,903 | B2 * | 7/2018 | McCambridge | B26B 19/20 |

* cited by examiner

FLIP-COMB MECHANISM FOR HAIR CLIPPER

RELATED APPLICATIONS

The present application claims the benefit under 35 USC 119(e) of US Provisional Application Nos. 62/902,809, filed Sep. 19, 2019; 62/902,840, filed Sep. 19, 2019; and 62/902,846, filed Sep. 19, 2019, the entire contents of all of which are incorporated by reference herein.

BACKGROUND

The present invention relates generally to powered hair cutting appliances, namely hair clippers and hair trimmers, collectively referred to here as hair clippers, and more specifically to such devices used for grooming pets.

Hair clippers, used for both cutting hair and animal fur, typically cut hair by reciprocating a moving blade relative to a stationary blade. Both the moving blade and the stationary blade have aligned teeth. The motion of the moving blade relative to the stationary blade causes any hair between the blade teeth to be cut as the moving blade reciprocates.

These hair clippers also are provided with accessories such as attachment combs or comb guides that allow the hair to be cut at a predetermined height or length. Traditionally, these combs clip onto the hair clippers as a single unit. However, during the cutting operation, some of the hair becomes caught in the comb or between the comb and the stationary blade instead of falling to the ground. When too much hair is stuck in the comb, the user has to stop cutting the hair or fur to shake the hair out of the comb or take the comb off entirely.

Thus, a common problem of pet groomers, especially those grooming long haired pets, is that the cut hair or fur, collectively referred to here as hair, collects near the blades, especially between attachment combs and the blades, and must be frequently cleared by the user during the grooming operation.

Thus, there is a need for an improved hair clipper having an attachment comb that resolves the problem of frequent hair clogging.

SUMMARY

The above-identified need is met or exceeded by the present hair clipper attachment comb system, which features a user-activated flip mechanism that moves the attachment comb between an operational position, close to or adjacent the clipper stationary blade, and an open, release or non-operational position, in which the comb is temporarily displaced from the stationary blade, allowing the release of trapped, collected hair. Once the collected hair is released, the user quickly causes the attachment comb to resume the operational position, so that the grooming operation is rapidly resumed. In a broad sense, embodiments disclosed herein provide for the use of hair clipper attachment comb system that employs a mount for connecting the attachment comb to the hair clipper. The mount allows the user to transition the attachment comb between the aforementioned operational and non-operational positions.

A feature of the present device is that a user has the option of partially uncoupling the attachment comb, and thus releasing hair caught between the attachment comb and the stationary blade. This enables user cleaning the hair clipper of excess hair more quickly and efficiently than is presently available in conventional units.

In an embodiment, the present flip mechanism is the mount in the form of a spring biased clip which biases the attachment comb to the operational position. A user-activated handle of the clip is grasped to overcome the biasing force, move the attachment comb to the release position, and release the collected hair. To resume operation, the user optionally quickly releases the grip on the handle, or otherwise guides the attachment comb back to the operational position in a slower process.

In an embodiment, the attachment comb is fixed to the flip mechanism. In another embodiment, the attachment comb is constructed and arranged for releasable engagement with the flip comb mechanism, so that the size and/or configuration of the attachment comb is readily changed. In one embodiment, the present flip comb mechanism includes at least one magnet element in a base plate and on the comb with a hinge connecting the base plate to the comb. As a result, the comb is rotatable about the hinge. When the comb is rotated about the hinge, the attachment comb remains on the hair clipper, but the hair can be quickly removed from the comb and/or the blades.

More specifically, a flip comb mechanism is provided for a hair clipper having a bladeset including a moving blade reciprocating relative to a stationary blade, the flip comb mechanism includes an attachment comb having at least one comb tooth and a comb base. The flip comb mechanism also includes a mount with a hinged bracket, having a first portion which is attached to the stationary blade, and a second portion which is attached to the comb base, the hinged bracket is configured to pivot the attachment comb between an operational position located adjacent to the stationary blade, and an open position where the attachment comb is rotated away from the stationary blade to clear collected cut hair between the attachment comb and the stationary blade, wherein a hinge of the hinged bracket is proximate the comb base.

In an embodiment, the mount includes a hinged bracket with a first opposed flap that has a first handle, and wherein the hinged bracket includes a second opposed flap that has a second handle, and the hinged bracket includes a biasing element for biasing the comb into the operational position.

In another embodiment, the second opposed flap is configured for releasably accommodating the attachment comb. In an embodiment, the mount includes a hinged bracket where the second opposed flap has a tongue, and the attachment comb has a socket configured for slidably receiving the tongue. In an embodiment, the second opposed flap has a clip for releasably engaging the attachment comb.

In still another embodiment, a flip comb attachment mechanism configured for coupling with a hair clipper is provided, including a mount including a base plate removably coupled to a stationary blade of the hair clipper, a hinge coupled to the base plate, an attachment comb hingedly attached to the base plate via the hinge, and configured to removably couple to the stationary blade of the hair clipper. One of the base plate and the attachment comb are selectively uncoupled from the stationary blade while the other of the base plate and the attachment comb is coupled to the stationary blade.

In an embodiment, the base plate is coupled to the attachment comb at an oblique angle such that when the base plate is removably coupled, via at least one first magnetic element, to said stationary blade, the attachment comb is not coupled to the stationary blade via at least one second magnetic element.

In yet another embodiment, a hair clipper with a flip-comb mechanism is provided, including a stationary blade defining a first mating plane, at least one attachment comb defining a second mating plane, and a mount for connecting the at least one attachment comb to the stationary blade. The mount is configured to pivot the at least one attachment comb away from the stationary blade to move the at least one attachment comb from an operational position to a non-operational position, wherein in the non-operational position, the first and second mating planes are non-parallel.

DETAILED DESCRIPTION

Figure 1:
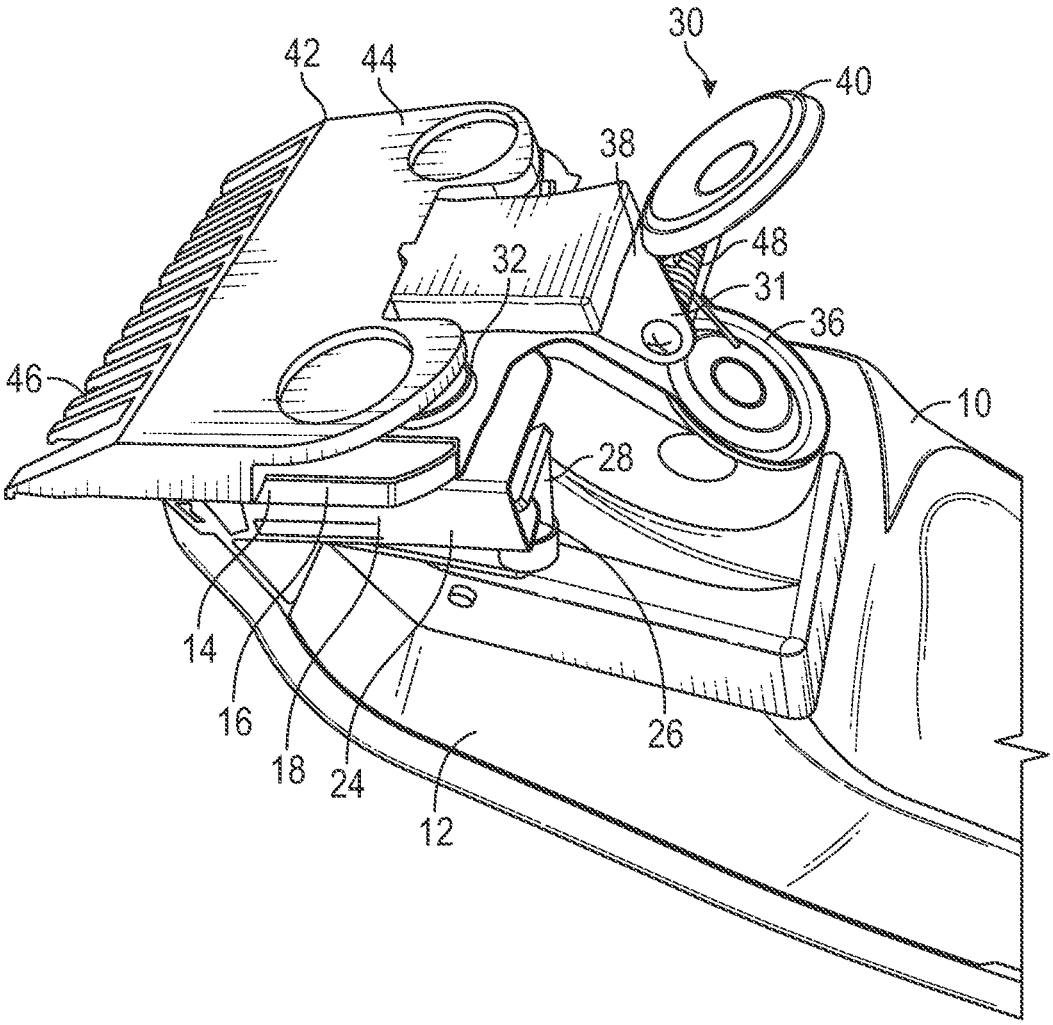
FIG. 1 is a fragmentary top perspective view of a hair clipper provided with the present flip-comb mechanism.

Referring now to FIGS. 1-4, an electric hair clipper suitable for use with the present flip-comb mechanism is generally designated 10, and as is well known in the art, includes a clipper housing 12 enclosing a motor, power system such as a battery, and a moving blade power transmission mechanism (all not shown). A clipper bladeset 14 includes a stationary blade 16 secured to the housing, and a laterally reciprocating moving blade 18. The stationary blade 16 includes a blade base 20 and a plurality of cutting teeth 22.

The bladeset 14 is secured to the housing 12 using a bladeset bracket 24. The bladeset bracket 24 is generally "U"-shaped when viewed from the rear. Such bladeset brackets 24 are slidably engaged on the housing 12, in a preferred construction with edges 26 engaged in grooves 28 on the housing.

Attached to the stationary blade 16 is the present flip comb mechanism generally designated 30, featuring a mount suitable for mounting an attachment comb 42 as described below to the hair clipper 10, and more particularly to the stationary blade 16. While several examples of a mount are presented by the following disclosure, it is contemplated by the instant invention that a "mount" as used herein may be any mechanical structure suitable for connecting an attachment comb (e.g. attachment comb 42) to a bladeset (e.g. bladeset 14) which allows a user to transition the attachment comb from an operational position wherein it is adjacent the bladeset to a non-operation position where it is displaced from the bladeset.

In the illustration of FIGS. 1-4, the mount is in the form of a hinged bracket 31, which is held to the stationary blade by a pair of fasteners 32. Preferably, the fasteners 32 also secure the stationary blade 16 to the bladeset bracket 24. Included on the hinged bracket 31 is a first opposed flap 34, which is located between the fasteners 30 and the stationary blade 16 and is intended to keep the hinged bracket in place upon the hair clipper 10. Preferably, the first opposed flap 34 has a first handle 36.

Figure 2:
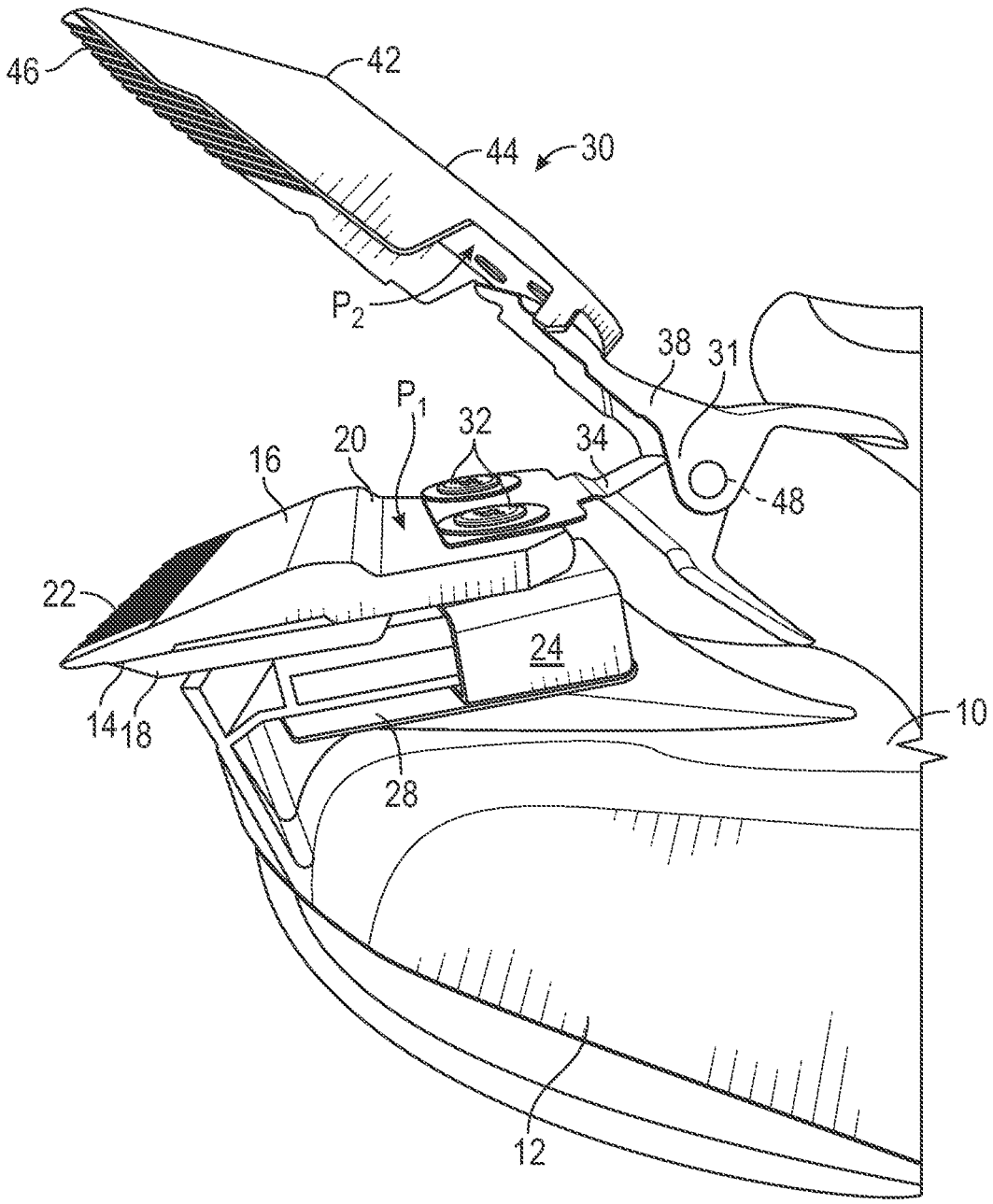
FIG. 2 is a fragmentary side view of the hair clipper of FIG. 1 with the manual flip-comb in the non-operational position.

In addition, the hinged bracket 31 has a second opposed flap 38, which is preferably connected to a second handle 40. The handles 36, 40 are used, once grasped by the user, to rotate the second opposed flap 38 of the hinged bracket 31. An attachment comb 42 having a comb base 44 and a plurality of comb teeth 46 is attached to the second opposed flap 34. Within the hinged bracket 31, a biasing element, 48, preferably a spring, biases the hinged bracket so that, in a rest position, the attachment comb 42 is biased into a position that is adjacent the stationary blade 16 in an operational position such that a first mating plane $P_1$ defined by the stationary blade 16 faces a second mating plane $P_2$ defined by the attachment comb 42. When the handles 36, 40 are activated by the user, by squeezing them together, thus overcoming the biasing force of the spring 48, the second opposed flap 38 rotates away from the first opposed flap 34 and away from the stationary blade 16, thereby putting the hair clipper 10 in a non-operational state wherein the first and second mating planes $P_1$, $P_2$ are non-parallel as is shown in FIG. 2. By releasing the handles 36, 40 the hinged bracket 31 and the attachment comb 42 return to the operational position.

Referring now to FIG. 2, the hair clipper 10 is shown in a non-operational position. Specifically, a user engages the first and second handles 36 40, which cause the second opposed flap 38 and the attachment comb 42 to rotate or pivot away from the first opposed flap 34 and the stationary blade 16.

Figure 3:
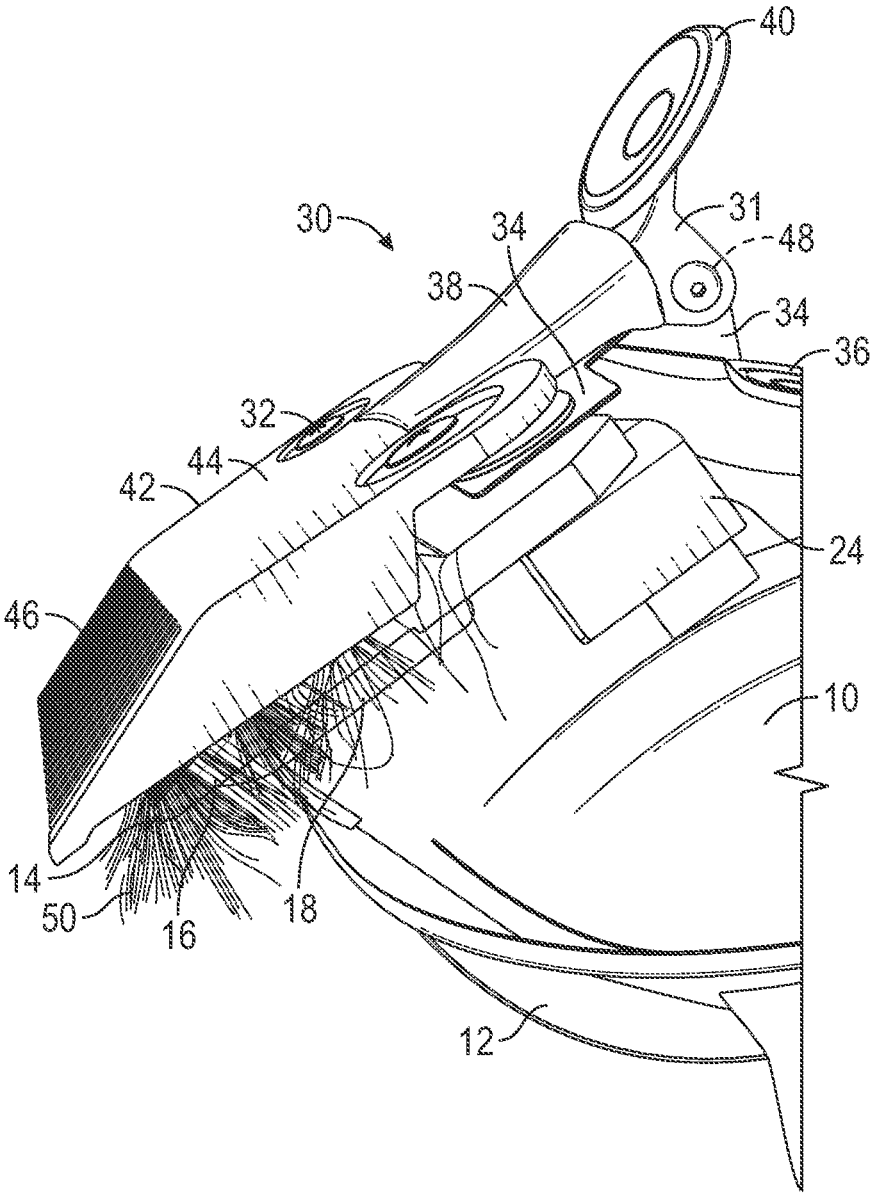
FIG. 3 is a fragmentary side view of the hair clipper of FIG. 1 with the comb in the operational position and filled with hair.
Figure 4:
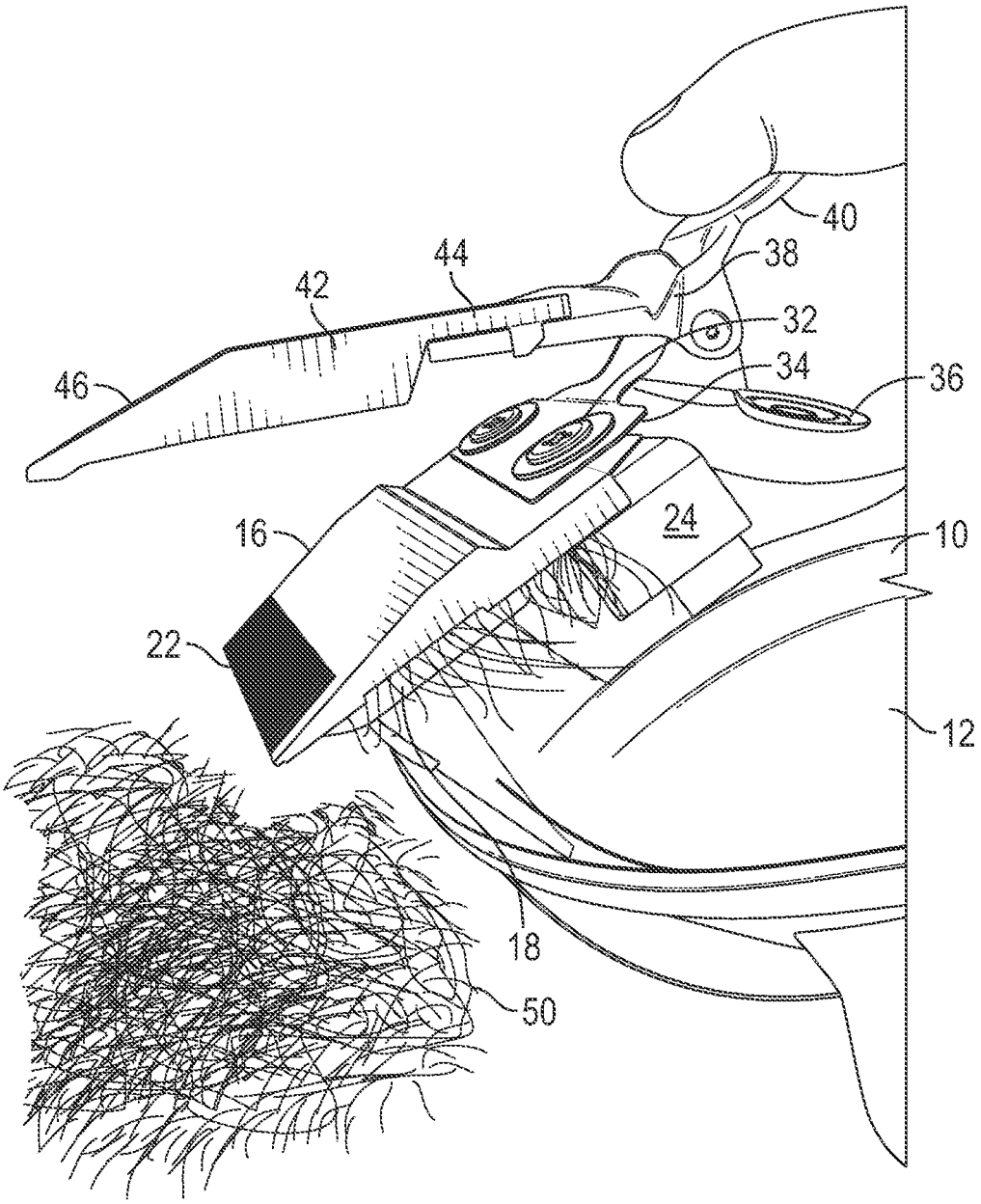
FIG. 4 is a fragmentary side view of the hair clipper of FIG. 1 with the manual flip-comb in the non-operational position with collected hair being released.
Figure 5:
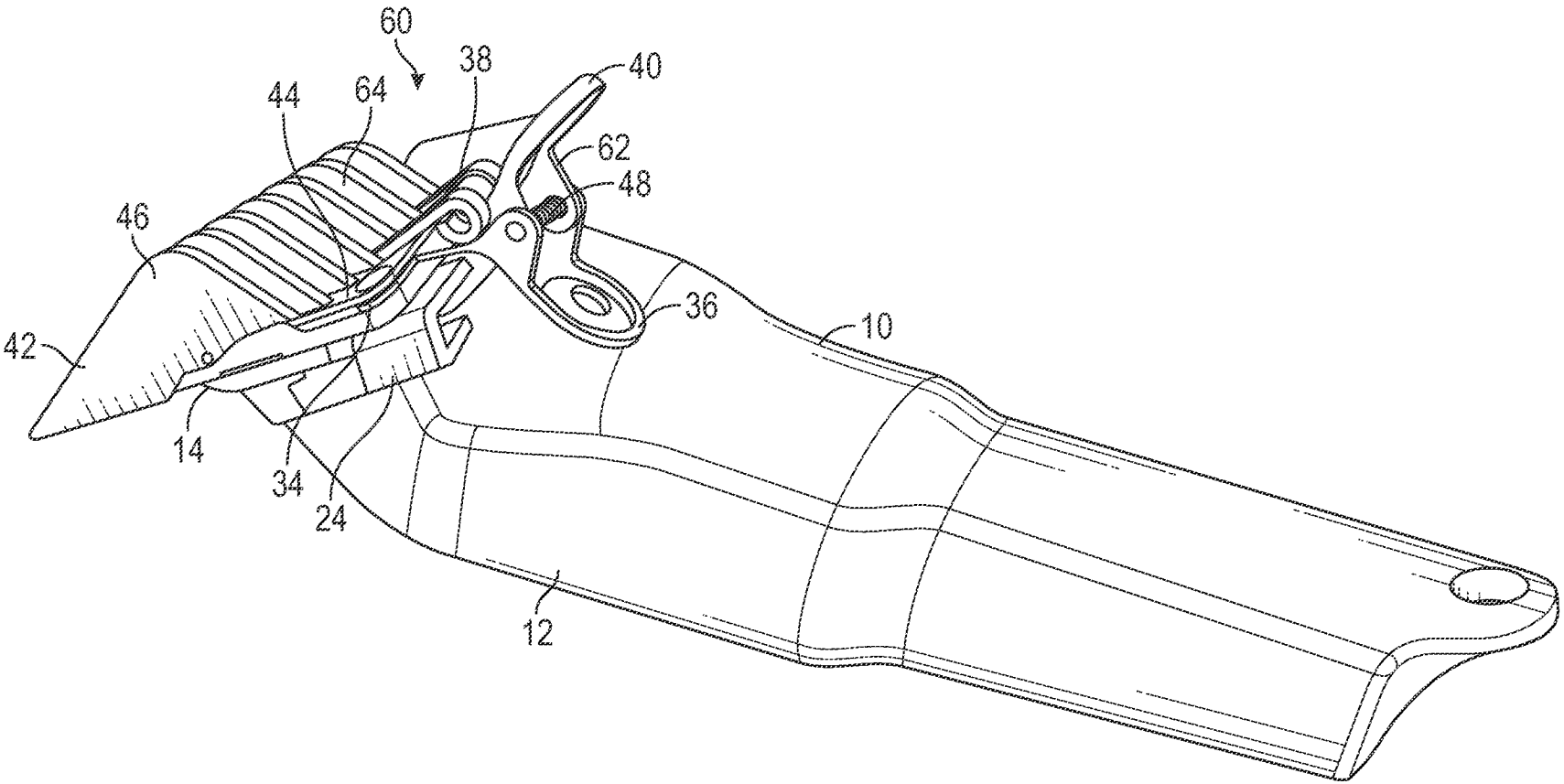
FIG. 5 is a bottom perspective view of a hair clipper with another embodiment of the present manual flip-comb featuring interchangeable comb sizes.
Figure 6:
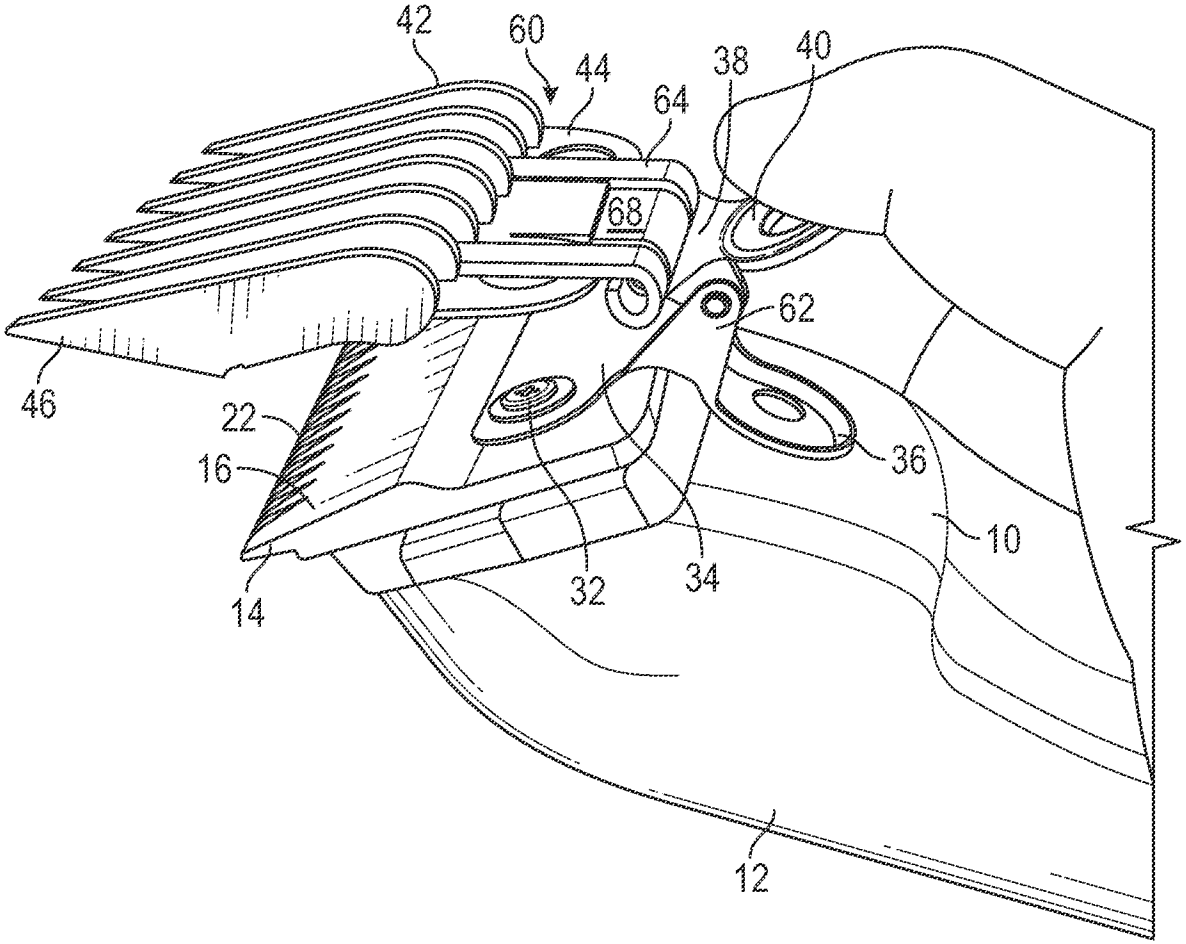
FIG. 6 is a fragmentary bottom perspective view of the hair clipper of FIG. 5 with the manual flip-comb in an open, non-operational position.

Referring now to FIGS. 3 and 4, the operation of the hair clipper 10 is shown when hair has been collected. Specifically, FIG. 3 shows the hair clipper 10 in an operational position, where hair 50 has been collected between the comb 42 and the stationary blade 16. As seen from FIGS. 3 and 4, there is a significant amount of hair 50 trapped between the comb 42 and the stationary blade 16, meaning that the hair must be cleared from the hair clipper 10 before proper operation may resume. Accordingly, FIG. 4 shows the hair clipper 10 in the non-operational position, with the handles 36, 40 actuated. Because the hair clipper 10 is in the non-operational position, the hair 50 easily removed.

Referring now to FIGS. 5-8, another embodiment of the present flip comb mechanism is generally designated 60.

Components shared with the flip comb mechanism 30 are designated with identical reference numbers.

Attached to the stationary blade 16 is a mount in the form of a hinged bracket 62, which, like the bracket 31, is held to the stationary blade 16 by the pair of fasteners 32. The fasteners 32 also secure the stationary blade 16 to the bladeset bracket 24.

Included on the hinged bracket 62 is the first opposed flap 34, which is located between, and vertically displaced from, the fasteners 32 and is intended to keep the hinged bracket 62 in place upon the hair clipper 10. In addition, the hinged bracket 62 has the second opposed flap 38, which is connected to the second handle 40. The handle 40, in conjunction with the handle 36 is used to rotate the second opposed flap 38 of the hinged bracket 62 away from the stationary blade 16.

Figure 7:
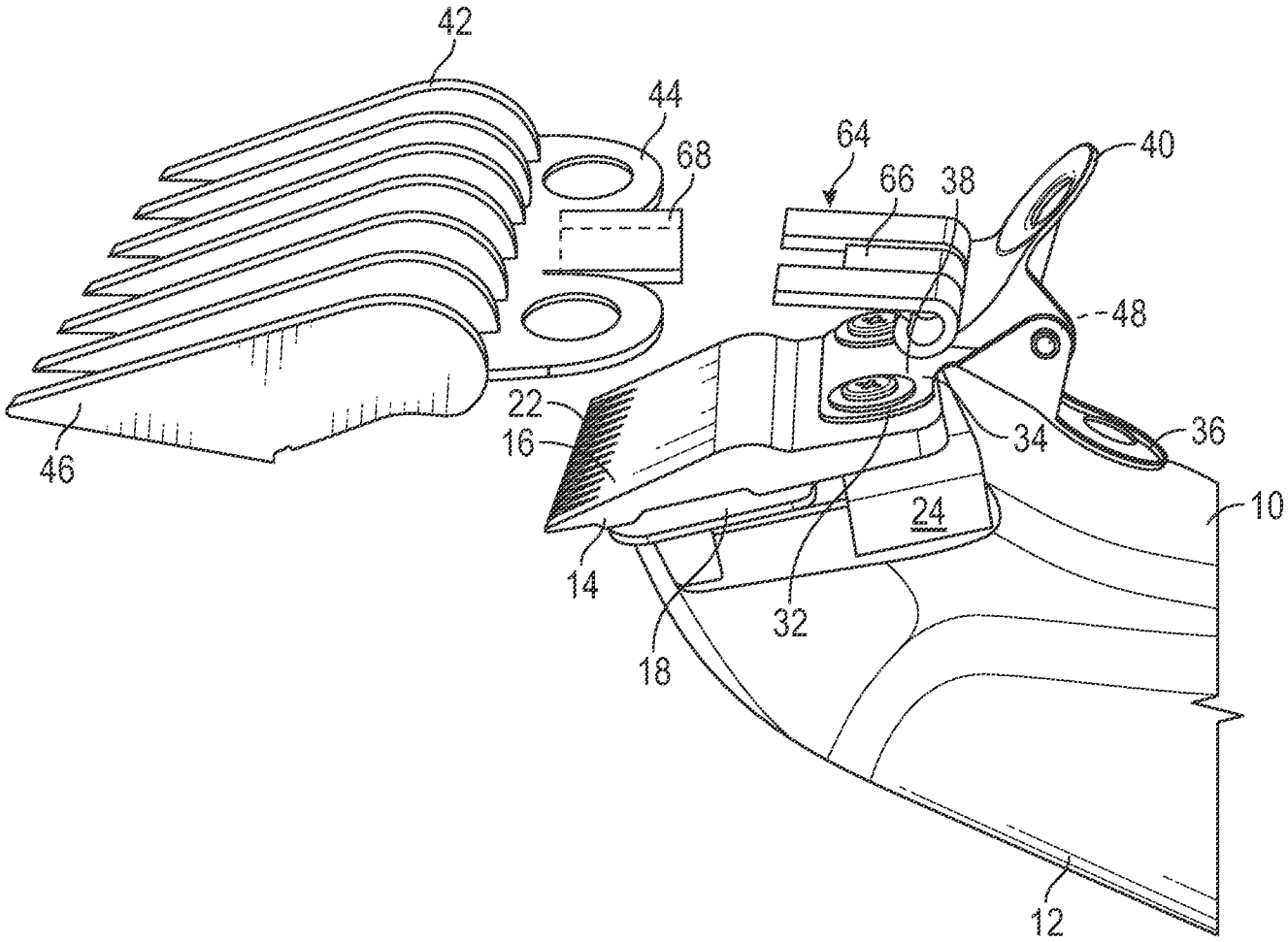
FIG. 7 is a fragmentary side view of the hair clipper of FIG. 5 with the manual flip-comb being detached from the clipper.

Referring now to FIG. 7, a main difference of the bracket 62 compared to the bracket 30 is a clip 64 is located on the second opposed flap 38 and one of a plurality of attachment combs 42 is removably attached to the clip 64. A variety of attachment formations is contemplated, including plug and opening, tongue and groove and the like as is well known in the art. In FIG. 7, the clip 64 is shown as a tongue 66, and the attachment comb 42 is provided with a socket 68.

Figure 8:
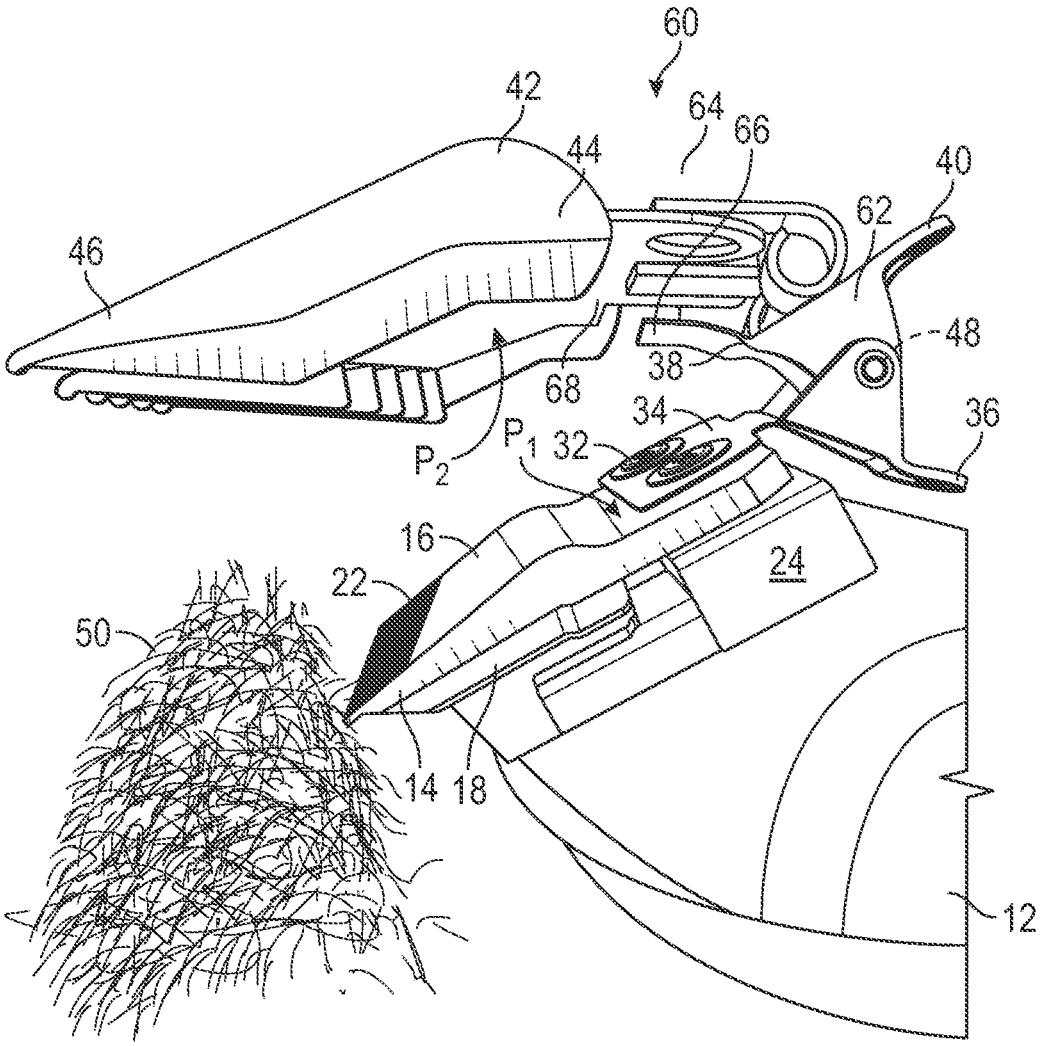
FIG. 8 is a fragmentary side perspective view of the hair clipper of FIG. 5 with the manual flip-comb in the non-operational position, releasing the collected cut hair.

As is known in the art, attachment combs 42 are provided in a variety of sizes, each corresponding to a desired cutting length. The user can easily change the desired cutting length in the present clipper 10 by removing the comb 42 at the clip 64, and plugging in a new comb of a different size. Within the hinged bracket 62, the biasing element, 48, preferably a spring biases the hinged bracket 62 so that, in an operational position, the comb 42 is adjacent to, and depending upon the biasing force, optionally rests in contact with the stationary blade 16 such that the first mating plane $P_1$ defined by the stationary blade 16 faces the second mating plane $P_2$ defined by the attachment comb 42. When the handles 36, 40 are activated by the user and overcomes the biasing force of the spring 48, the second opposed flap 38 rotates away from the first opposed flap 34, thereby putting the hair clipper 10 in a non-operational state. In the non-operational state, the attachment comb 42 is held away from the stationary blade 16 such that the first and second mating planes $P_1$, $P_2$ are non-parallel as is shown in FIG. 8. Referring now to FIG. 8, in the non-operational or release position, any collected hair 50 obtained through the operation of the hair clipper 10 is easily removed by the user. By releasing the second handle 40, the hinged bracket 62 and the attachment comb 42 return to the operational position.

Thus, by providing the present clip 64 and the hinged bracket 62, the present clipper 10 equipped with the flip comb mechanism 60 provides the user with the ability to rapidly removed collected hair and resume clipping. In addition, combs 42 are easily exchanged.

Referring now to FIGS. 9-13, still another embodiment of the present flip comb mechanism is generally designated 70. Components shared with the mechanisms 30 and 60 are designated with identical reference numbers. A main distinctive feature of the flip comb mechanism 70 is the use of one or more magnetic elements to secure at least one and preferably both a hinged bracket and the attachment comb to the hair clipper 10, and more specifically, the stationary blade 16. These magnetic elements may take the form of any magnetic structure and may be designed to assume any shape to allow for mounting as described herein.

Figure 9:
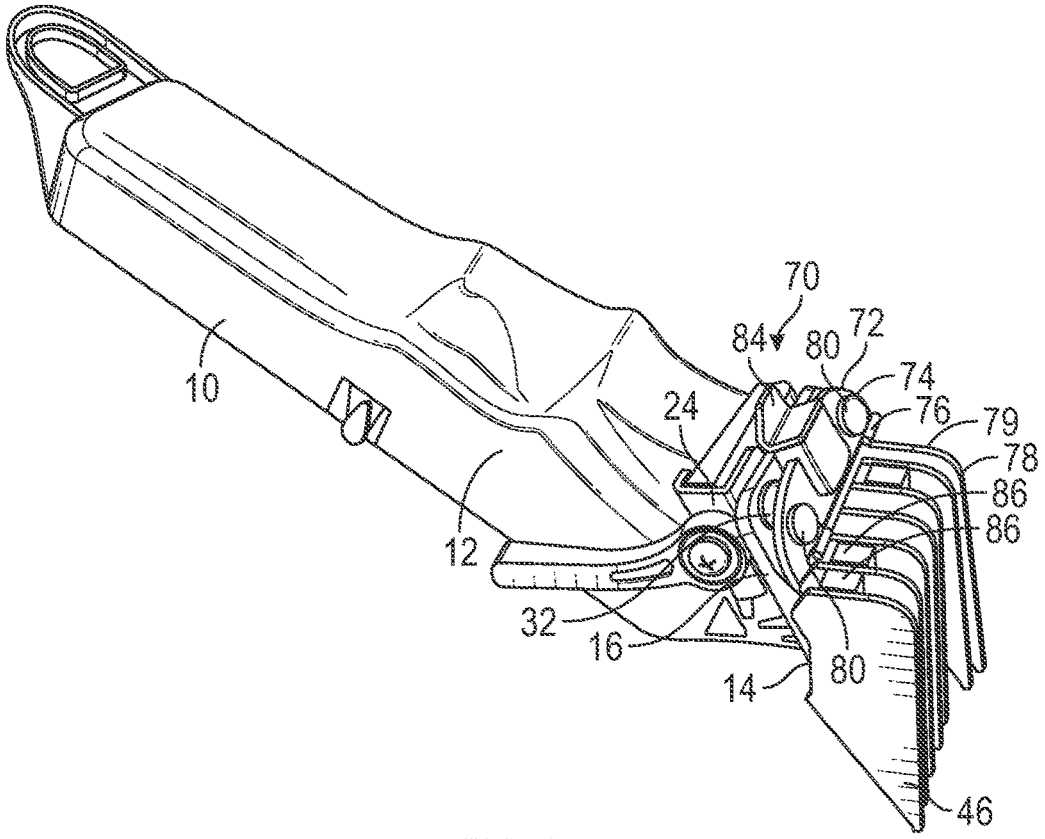
FIG. 9 is a bottom perspective view of a hair clipper including yet another embodiment of the present flip-comb apparatus.
Figure 10:
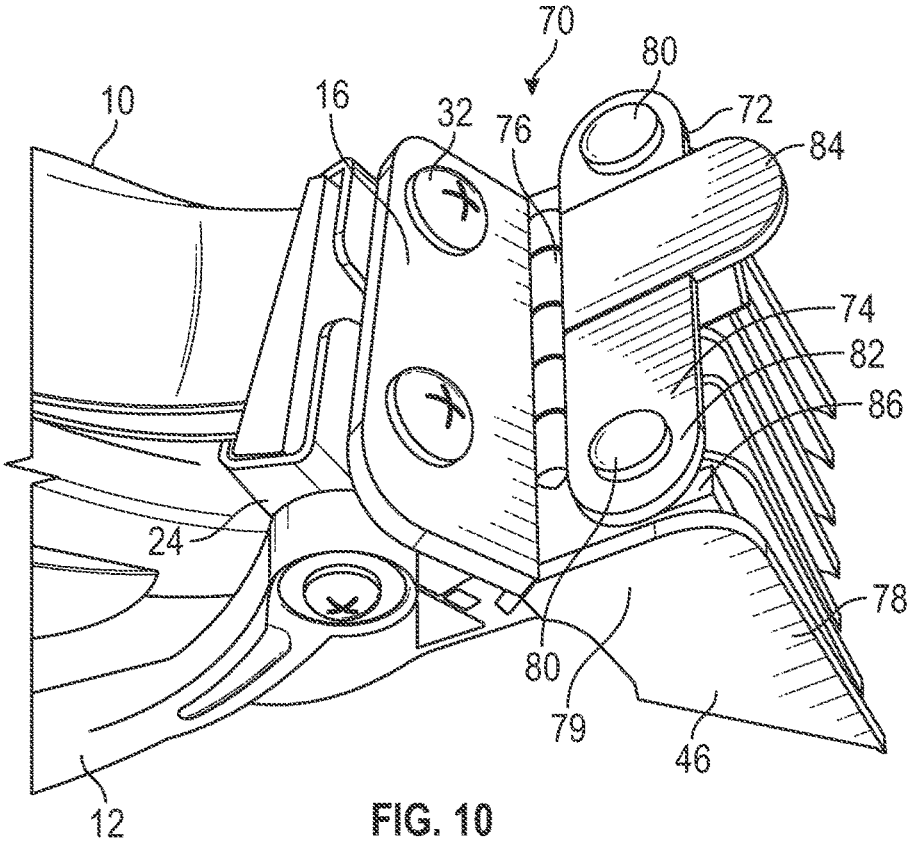
FIG. 10 is a fragmentary perspective view of the attachment comb magnetically attached to the hair clipper of FIG. 9 so that the attachment comb is in an operational position, with the pivoting bracket detached from the stationary blade.

Referring now to FIGS. 9 and 10, included on the mechanism 70 is a mount in the form of a hinged bracket 72 having a base plate 74 analogous to the first opposed flap 34, a hinge 76, and an attachment comb 78 with a base 79 analogous to the second opposed flap 38 which is connected to the base plate via the hinge. In other embodiments, it is contemplated that the hinged bracket 72 optionally includes other typical hair clipper attachments in lieu of the attachment comb 78, such as a blade guard (not shown). As is the case with the mechanisms 30 and 60, in the mechanism 70, the hinged bracket 72 is secured to the stationary blade 16 of the hair clipper 10. However, in a preferred embodiment of the mechanism 70, both the base plate 74 and the attachment comb 78 include magnets to removably couple to the stationary blade 16 of the hair clipper 10.

More specifically, the base plate 74 has at least one and preferably a pair of base plate magnetic elements 80, also referred to as magnets, that releasably secure the hinged bracket 72 to the stationary blade 16. In FIG. 10, the attachment comb 78 is coupled to the stationary blade 16 in an operational position, with the base plate 74 uncoupled from the stationary blade and pivoted away from that blade about the hinge 76. It is preferred that the base plate magnets 80 project from an underside 82 of the base plate 74, however it is also contemplated that the magnets protrude through both sides of the base plate. It is also contemplated that the magnets 80 are embedded into the base plate 74 to be invisible to the user.

A projection or handle 84 is secured to the base plate 74 and allows for increased control of the base plate 74 when hingedly rotating the base plate about the hinge 76. In the current example, the projection 84 is centrally located on the base plate 74 on the underside 82, however other locations are contemplated, and in some cases, the projection is considered optional. The depicted placement of the projection 84 allows for enhanced torque to be applied to the base plate 74 during rotation about the hinge 76.

Figure 11:
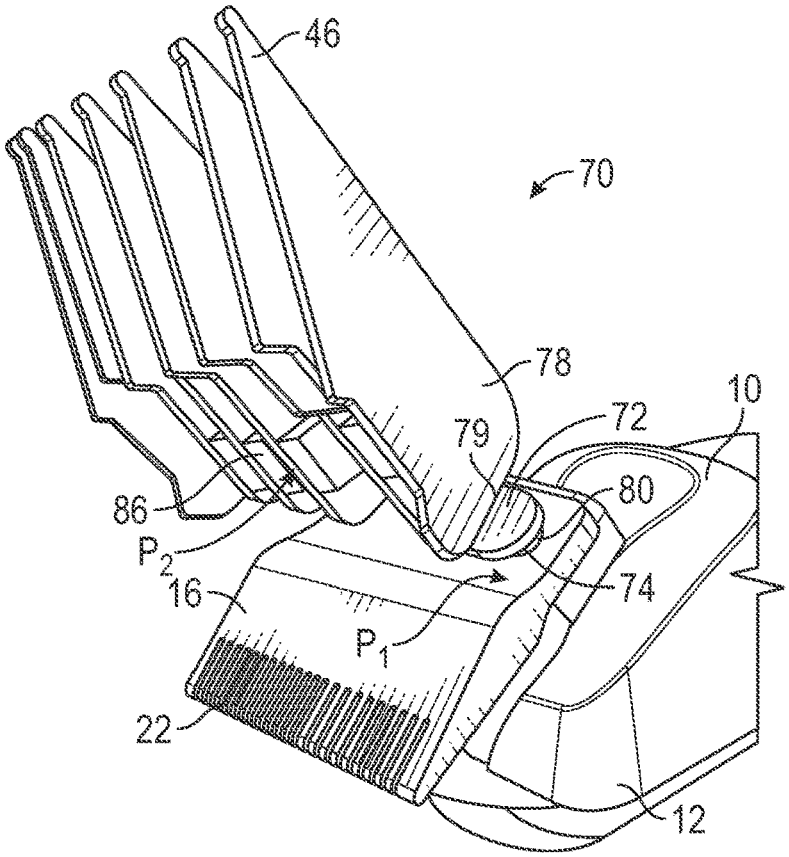
FIG. 11 is a fragmentary perspective view of the flip comb mechanism of FIG. 9 with the attachment comb detached from the stationary blade.

Referring now to FIG. 11, the base plate 74 is shown coupled to the stationary blade 16, while the attachment comb 78 is not coupled to the stationary blade, and instead is projecting at an approximate 90° angle thereto. As shown, the attachment comb 78 is hingedly rotated about the hinge 76 with respect to the base plate 74. As a result, both the teeth 22 of the stationary blade 16 and comb magnets 86 are visible. The comb magnets 86 enable removable coupling of the attachment comb 78 from the stationary blade 16. In some examples, the preferred plurality of comb magnets 86 are embedded in the comb 78 and are not visible.

The flip comb mechanism 70 as shown in FIGS. 9-13 is configured to be fully coupled to the stationary blade 16, partially coupled to the stationary blade, or fully uncoupled from the blade. FIG. 10 shows that the flip comb mechanism 70, shown in an operational position such that first and second mating planes $P_1$, $P_2$ (see FIG. 11) defined by stationary blade 16 and attachment comb 78, respectively, face one another, is configured to be partially coupled to the stationary blade 16 even though the base plate 74 is rotated about the hinge 76 while the attachment comb 78 is coupled to the stationary blade 16. Referring now to FIG. 11, the flip comb mechanism 70 is optionally partially coupled to the stationary blade 16 in a hair clearing position, when the attachment comb 78 is rotated about the hinge 76 approximately 90 degrees, while the base plate 74 is coupled to the stationary blade 16. As can also be seen in this view, the attachment comb 78 is in its non-operational position such that the first and second mating planes $P_1$, $P_2$ are non-parallel.

Figure 12:
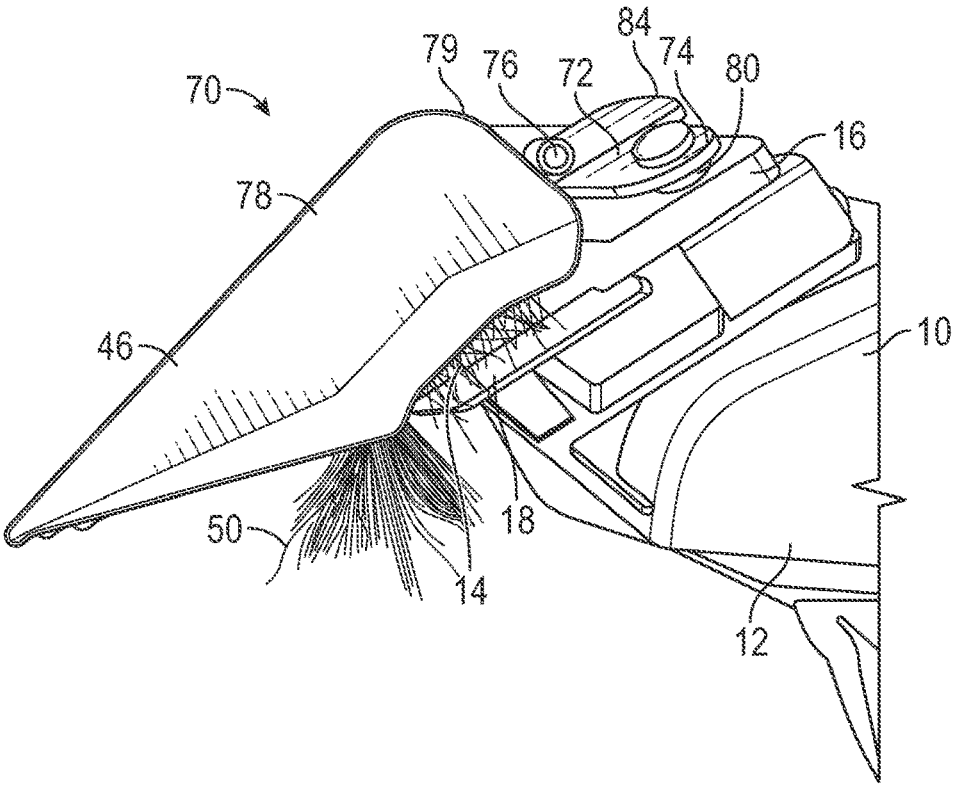
FIG. 12 is a fragmentary side view of the attachment comb and base plate magnetically attached to the hair clipper of FIG. 9.
Figure 13:
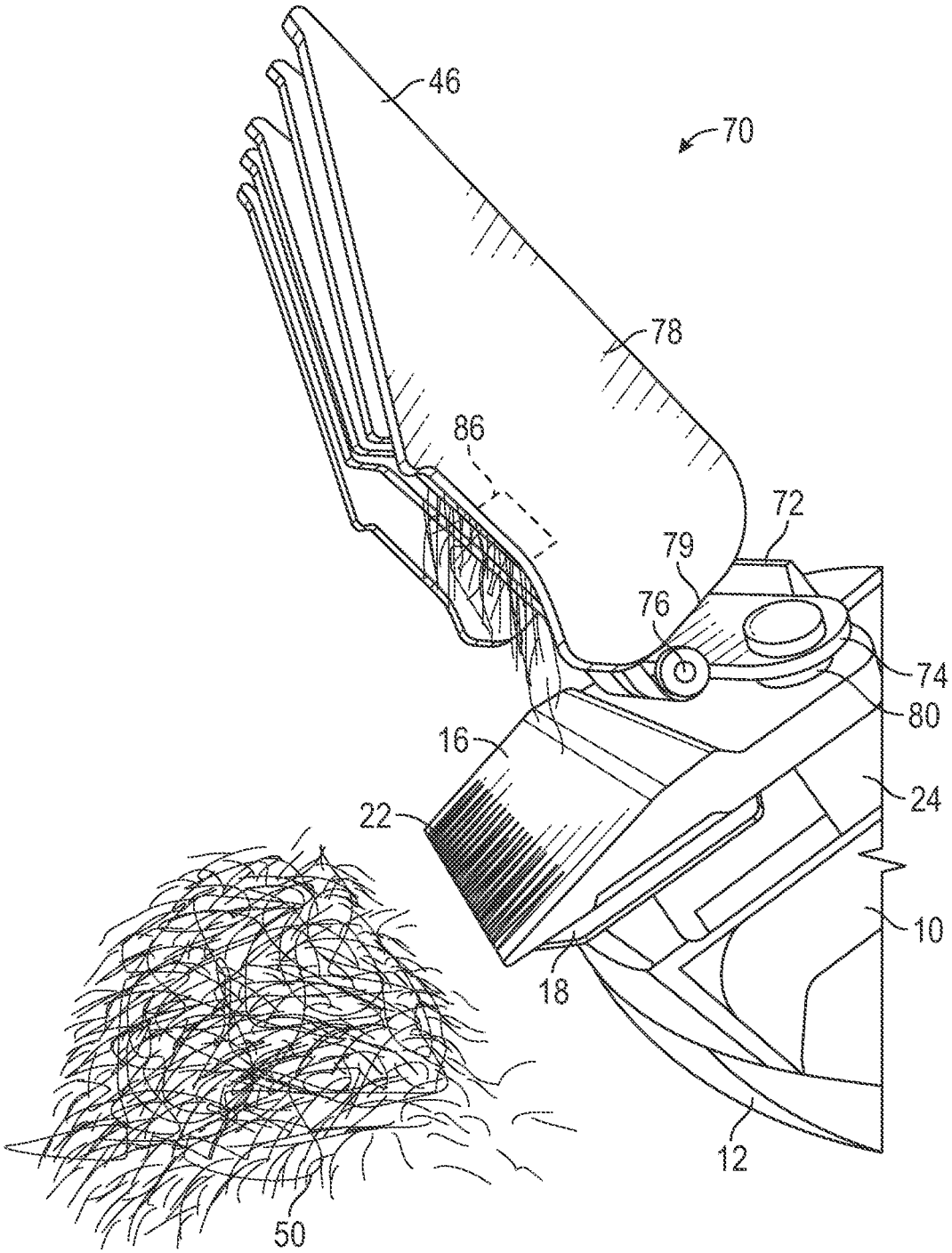
FIG. 13 is an enlarged fragmentary side view of the hair clipper of FIG. 12 showing the attachment comb opened up to release the trapped hair.

Referring now to FIGS. 12 and 13, the flip comb mechanism 70 facilitates the quick removal of hair clogged in the attachment comb 78. For example, FIG. 12 shows a side view of the flip comb mechanism 70 with both the attachment comb 78 and the base plate 74 coupled to the stationary blade 16. Hair 50 is caught between the attachment comb 78, the stationary blade 16, and/or the moving blade 18. Using the hair clipper 10 with so much trapped hair 50 in this state is undesirable and inefficient.

Accordingly, FIG. 13 shows the present flip comb mechanism 70 with the attachment comb 78 hingedly rotated such that the hair 50 is released. The attachment comb 78, rotated relative to the stationary blade 16 so that it is only partially coupled to the blade, allows for a quick removal of the hair 50 and a quick recoupling of the attachment comb. This increases the efficiency with which users can cut hair in spite of long hair typically becoming caught in the attachment comb 78 or between the comb and the stationary blade 16.

In an alternative embodiment, the flip comb mechanism 70 is merely an attachment comb 78 having the base plate magnets 80 disposed along a base of the comb teeth 46 that, when the comb is rotated 90° or at some other angle to the stationary blade 16, retain the comb at an elevated position for clearing of hair 50. Additionally, the attachment comb 78 is removably coupled to the stationary blade 16 by the comb magnets 86 which are secured to the comb teeth as seen in FIG. 11.

Accordingly, when a user clears the attachment comb 78 of hair 50, the user pivots the attachment comb from being coupled to the stationary blade 16 via magnets 86 to being coupled via magnets 80. When the attachment comb 78 is coupled to the stationary blade 16 via magnets 80 on the base plate 74, the hair quickly falls from the hair clipper 10.

While a particular embodiment of the present flip comb mechanism has been described herein, it will be appreciated by those skilled in the art that changes and modifications may be made thereto without departing from the invention in its broader aspects and as set forth in the following claims.

What is claimed:

1. A flip comb mechanism for a hair clipper having a bladeset including a moving blade reciprocating relative to a stationary blade, said flip comb mechanism comprising:

an attachment comb having at least one comb tooth and a comb base;

a mount comprising a hinged bracket, having a first portion which is configured for directly attachment to the stationary blade, and a second portion which is attached to said comb base;

said mount being secured to the stationary blade using a pair of fasteners also used for securing the stationary blade to a bladeset bracket on the hair clipper;

said hinged bracket is configured to pivot said attachment comb between an operational position located adjacent to the stationary blade, said hinged bracket including a biasing element configured for biasing said attachment comb against the stationary blade, and an open position where said attachment comb is rotated away from the stationary blade against the force of said biasing element to clear collected cut hair between said attachment comb and the stationary blade, wherein a hinge of said hinged bracket is proximate said comb base.

2. The flip comb mechanism of claim 1, wherein said hinged bracket includes a first flap that has a first handle, and wherein said hinged bracket includes a second flap that has a second handle, and said hinged bracket includes said biasing element for biasing said attachment comb into said operational position, wherein said biasing element has a first end operably connected to said first handle, and a second end operably connected to said second handle for biasing said attachment comb into said operational position.

3. The flip comb mechanism of claim 2, wherein said second flap is configured for releasably accommodating said attachment comb.

4. The flip comb mechanism of claim 3, wherein said second flap has a tongue, and said attachment comb has a socket configured for slidably receiving said tongue.

5. The flip comb mechanism of claim 3, wherein said second flap has a clip for releasably engaging said attachment comb.

6. A hair clipper with a flip-comb mechanism, said hair clipper comprising:

a stationary blade defining a first plane;

at least one attachment comb defining a second plane;

a mount for directly connecting said at least one attachment comb to said stationary blade;

said mount being secured to the stationary blade using a pair of fasteners also used for securing the stationary blade to a bladeset bracket on the hair clipper;

wherein said mount is configured to pivot said at least one attachment comb away from said stationary blade to move said at least one attachment comb from an operational position to a non-operational position, wherein in the non-operational position, the first and second planes are non-parallel, wherein said mount pivots about a point proximate a comb base of said at least one attachment comb said mount including a hinged bracket having a biasing element configured for biasing said attachment comb against the stationary blade, and a user manipulates said comb against a force from said biasing element to move said at least one attachment comb to the non-operational position.

7. The hair clipper with a flip-comb mechanism of claim 6, wherein said biasing element has a first end operably connected to a first flap of said hinged bracket, and a second end operably connected to a second flap of said hinged bracket for biasing said attachment comb into said operational position.

8. The hair clipper with a flip-comb mechanism of claim 6, wherein said hinged bracket includes a first flap attached to said stationary blade and a second flap attached to said at least one attachment comb, wherein said second flap has a tongue, and said attachment comb has a socket configured for slidably receiving said tongue.

9. The hair clipper with a flip-comb mechanism of claim 6, wherein said hinged bracket includes a first flap attached to said stationary blade and a second flap attached to said at least one attachment comb, wherein said second flap has a clip for releasably engaging said attachment comb.

* * * * *